United States Patent [19]

Osaka et al.

[11] Patent Number: 4,517,953

[45] Date of Patent: May 21, 1985

[54] BALL THROWING MACHINE

[75] Inventors: Takatoshi Osaka; Katsuo Nishimura; Tadahiko Nakagiri, all of Saitama, Japan

[73] Assignee: Citizen Watch Co., Ltd., Tokyo, Japan

[21] Appl. No.: 460,125

[22] Filed: Jan. 21, 1983

[30] Foreign Application Priority Data

| | | | |
|---|---|---|---|
| May 6, 1982 | [JP] | Japan | 57-66097[U] |
| May 31, 1982 | [JP] | Japan | 57-80190[U] |
| May 31, 1982 | [JP] | Japan | 57-80189[U] |
| Oct. 1, 1982 | [JP] | Japan | 57-149930[U] |

[51] Int. Cl.[3] ..... F41B 7/00

[52] U.S. Cl. ..... 124/17; 200/61.41; 273/318; 273/26 D; 24/380

[58] Field of Search ..... 124/17, 32, 7, 36, 41 R, 124/47; 273/26 D, 318; 318/305, 345 F, 348; 310/68 R; 323/15; 320/57; 200/61.41

[56] References Cited

U.S. PATENT DOCUMENTS

| | | | |
|---|---|---|---|
| 1,761,030 | 6/1930 | Zwiebel | 200/61.41 |
| 2,696,204 | 12/1954 | Gilgoff | 124/7 |
| 4,269,162 | 5/1981 | Abraham et al. | 124/7 |
| 4,311,952 | 1/1982 | Mabuchi et al. | 320/57 X |
| 4,315,174 | 2/1982 | Doerr | 310/68 B |
| 4,368,885 | 1/1983 | Katada et al. | 124/36 X |

FOREIGN PATENT DOCUMENTS

| | | | |
|---|---|---|---|
| 604094 | 6/1948 | United Kingdom | 323/15 |

*Primary Examiner*—Richard J. Apley
*Assistant Examiner*—William R. Browne
*Attorney, Agent, or Firm*—Bernard, Rothwell & Brown

[57] ABSTRACT

A ball throwing machine for hitting out tennis balls or the like at predetermined time intervals, in which a lock cover is rotatable or slidable into engagement with a switch which is capable of making and breaking an electric current to a drive motor. Said lock cover is mounted in a position adjacent to a rotating trace of a hitting lever. In the event an object other than ball, for example, a hand, a finger or a rod, should be drawn into the interior of the machine together with the hitting lever while this lever is rotated by a motor to expand a biasing spring, the lock cover will rotate or slide to break the electric current to the motor and stop the motor immediately, thereby preventing the occurrence of injury.

2 Claims, 14 Drawing Figures

BALL THROWING MACHINE

BACKGROUND OF THE INVENTION

1. Field of the Invention

The present invention relates to a ball throwing machine for hitting out tennis balls or the like at predetermined time intervals, collecting the balls hit back with a racket or the like into a special net and again hitting out the balls.

2. Description of the Prior Art

Heretofore, ball throwing machines for tennis and baseball training have been installed at certain places for commercial purpose, and their size and power are large. Therefore the users and the place of use have been limited, and ample consideration has not been given to the safety of those machines.

However, because of a recent spread of small-sized portable ball throwing machines, it has become possible for anyone to handle such machines easily. On the other hand, in the event a hand, a finger, a rod or like object should be put into the ball throwing port by accident in a state of extremely strong torque when the hitting lever pivoting spring is stretched, it may be drawn into the interior of the machine by the hitting lever and an accidental injury or machine trouble may result. Further conventional ball throwing machines involve such a remarkable disadvantage in that it requires as long as 8–10 minutes for assembling its structural parts.

SUMMARY OF THE INVENTION

It is a primary object of the present invention to provide a ball throwing machine free from the conventional drawbacks mentioned above.

It is another object of the present invention to prevent the occurrence of injury or trouble of a ball throwing machine in the event an object other than ball such as a hand, a finger or a rod should be put into a ball throwing port.

It is a further object of the present invention to automatically let a lock cover revert to its original state and a motor rotate again upon removal of an object other than ball such as a hand, a finger or a rod from a ball throwing port.

It is another object of the present invention to ease injury or pain in the event a hand or a finger should be hit accidentally by a hitting lever.

It is a further object of the present invention to provide a ball throwing machine which exhibits good start-up and load characteristics under a large load.

Other objects and advantages of the present invention will become apparent from the following description of preferred embodiments of the invention taken in connection with the accompanying drawings.

BRIEF DESCRIPTION OF THE DRAWINGS

FIG. 3 (B) is a side view of FIG. 3 (A);

DESCRIPTION OF THE PREFERRED EMBODIMENT

Figure 1:
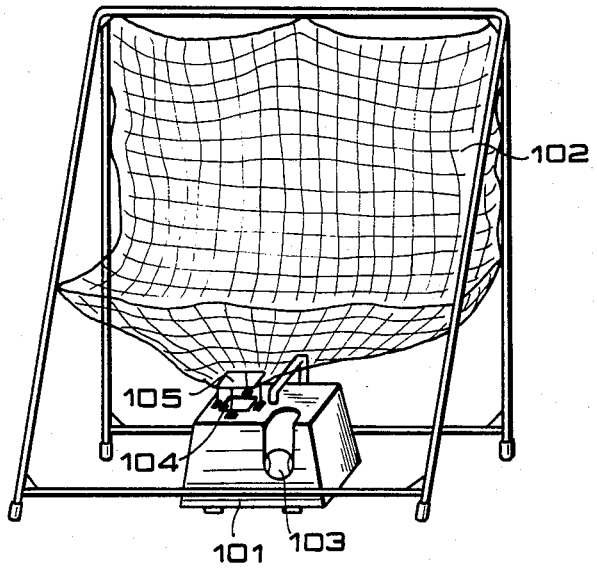
FIG. 1 is a perspective view showing the entirety of general ball throwing machine and collection net.

Referring to FIG. 1, there is shown a perspective view of the entirety of a ball throwing machine 101 and a ball collection net 102 according to the present invention, in which a ball 103 hit out from the ball throwing machine 101 and hit back with a racket, a bat or the like against the ball collection net 102 has its energy absorbed by the net and drops onto the bottom of the net. The bottom of the net is stretched so that the ball is conducted to a ball intake port 104 formed in the ball throwing machine 101, and it is provided with a ball collection port 105 so formed as to allow the ball to fall therethrough.

Figure 2:
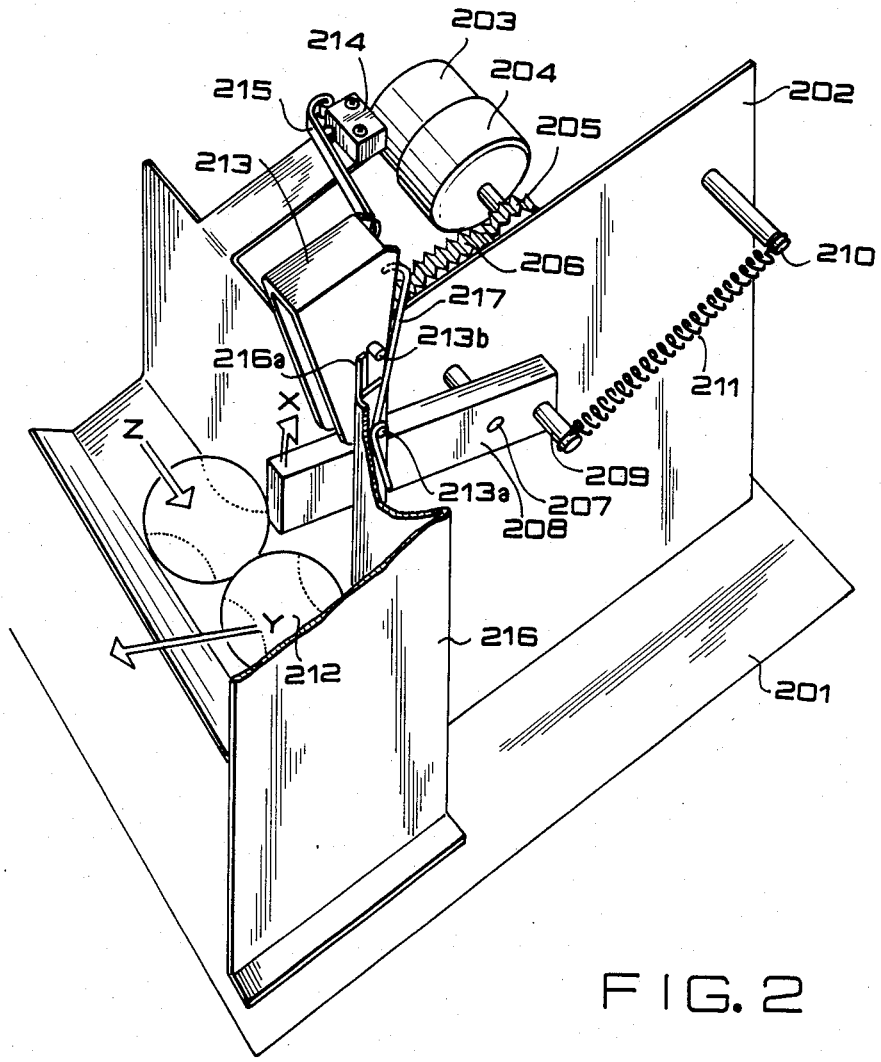
FIG. 2 is a perspective view showing the interior structure of a ball throwing machine according to an embodiment of the present invention.

Referring now to FIG. 2, there is shown a perspective view of the interior structure of a ball throwing machine according to an embodiment of the present invention, in which a main support 202 is fixed on a base 201, and on the main support 202 are mounted a motor 203, a reduction gear 204, a pinion 205 and a wheel 206, with a one-way clutch (not shown) being mounted between the wheel 206 and a shaft 207. A hitting lever 208 is fixed rotatably onto the shaft 207, and a spring anchor pin 209 is fixed on the hitting lever 208, with a spring 211 being stretched between the pin 209 and another spring anchor pin 210 fixed on the main support. As the motor 203 rotates, the hitting lever 208 is rotated in the direction of arrow X while expanding the spring 211, and the spring anchor pin 209 is pivotally moved to the opposite side of the shaft 207 with respect to the spring anchor pin 210 on the main support 202. In this way, when the spring anchor pin 209, shaft 207 and spring anchor pin 210 are aligned, the spring 211 exhibits the maximum strength. With further rotation of the shaft 207, the hitting lever 208 is rotated in the direction of arrow X rapidly by virtue of the maximumwise expanded spring 211. At this time, the shaft 207 and the wheel 206 are disconnected from each other by means of the one-way clutch. The hitting lever 208, when endowed with a rapid rotating force by the spring, hits out a ball 212 in the direction of a flying trace of the ball indicated at arrow Y. The hitting lever 208 after hitting out the ball 212 is again moved pivotally by the motor 203 through the reduction gear 204, pinion 205, wheel 206 and one-way clutch, and begins to expand the spring 211. This cycle is repeated.

When the motor 203 pivots the hitting lever 208, the reduction ratio is so large that the pivoting force of the hitting lever 208 becomes very large. Therefore, if a human hand or finger or a thing should touch the hitting lever and be drawn into the interior of the machine, a very dangerous condition would result.

Therefore, in addition to the machine structure described above, with a view to turning off the power source of the motor 203, a lock cover 213 as a safe detecting member is mounted between the main support 202 and an auxiliary support 216 pivotably through two shafts 213*a* (only one shown) which project in lower positions of the lock cover 213. The lock cover 213 undergoes an urging force toward the front of the machine at all times by means of a return spring 217 which has a fulcrum at one of the shafts 213*a* and which is retained to both an upper part of the auxiliary support 216 and that of the lock cover 213, and the lock cover 213 stops in the position where its positioning portion 213*b* abuts a stopper portion 216*a* of the auxiliary support 216.

The lock cover 213 deviates from the trace of a ball supply path Z and is so concaved as to span the pivoting trace of the hitting lever. Besides, it is in the form of a sector when viewed from its side, and has an end face so formed as to be capable of pushing an armature 215 of a switch 214, the switch 214 being mounted so that it can turn on and off the power source of the motor 203.

In the event a human hand or finger or any other object than ball should get in between the hitting lever 208 and the lock cover 213 so the hitting lever 208 tries to push it into the interior of the machine, a further pivotal movement of the hitting lever 208 causes the lock cover 213 to pivot against the return spring 217, so that the armature 215 of the switch 214 which engages the lock cover 213 is actuated, thereby causing the switch 214 to turn off the power source of the motor 203 to stop rotation of the hitting lever 208.

Upon removal of the object other than ball, the lock cover 213 is again pushed back to the front of the machine by the return spring 217 until it stops in the position where its positioning portion 213*b* abuts the stopper portion 216*a*, whereupon the armature 215 of the switch 214 is released, so the motor 203 again starts operating. The above safe detecting member may comprise a photo-sensor such as a photo-detection element, i.g. phototransistor, photodiode and photoconductive element.

Figure 3A:
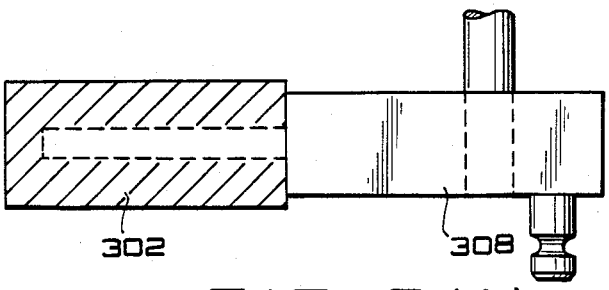
FIG. 3 (A) is a top view of a hitting lever according to a modified example of the present invention.
Figure 3B:
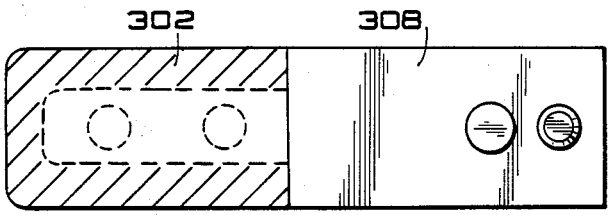

FIGS. 3 (A) and 3 (B) are a top view and a side view showing an example of a ball hitting lever 308 coated with rubber or synthetic resin, in which a metallic, ball hitting tip end portion of the hitting lever 308 is partially substituted by rubber or synthetic resin 302. Because of a high softness of the material, even if a hand or a finger should be struck by the hitting lever, it will not be injured so seriously. Also as to the flying distance of ball, a more efficient flying of ball is attainable by selecting an appropriate value of hardness in the case of using rubber, and thus a functional merit is also obtainable.

Figure 4:
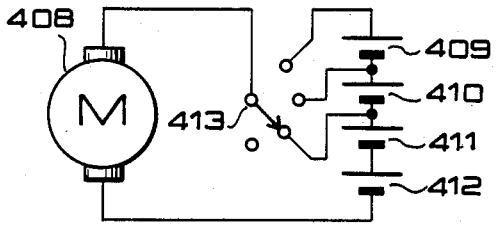
FIG. 4 (PRIOR ART)
FIGS. 4 and 5 are each a circuit diagram showing a speed adjusting system in a conventional ball throwing machine.
Figure 5:
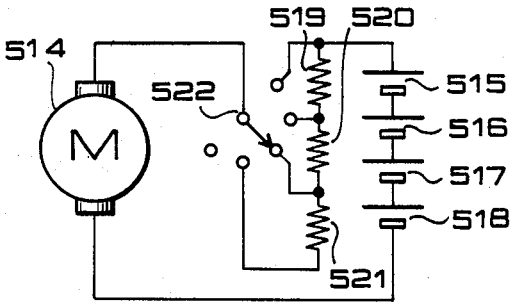
FIG 5 (PRIOR ART)

Referring now to FIGS. 4 and 5, there are shown speed adjusting systems in conventional ball throwing machines. In FIG. 4, which employs a switch for change-over of the supply voltage, the reference numeral 408 denotes a motor, the numerals 409 through 412 denote dry cells and 413 a change-over switch. Speed adjustment is effected by changing the number of dry cells 409–412 to be connected in series to thereby change the voltage to be fed to the motor 408. This system is disadvantageous in that the voltage adjustment is made in rough stages in the unit of the one dry cell and in that the dry cells tend to become unbalanced in their state of use, which may cause reverse charging or the like. Moreover, this system is inconvenient when the operation is to be performed with a single external power supply.

In FIG. 5, which employs a change-over switch for resistors connected in series with a power source, the reference numeral 514 denotes a motor, the numerals 515 through 518 denote dry cells, and further indicated at 519 through 521 are resistors and at 522 a change-over switch. Speed adjustment for the motor 514 is effected by changing with the change-over switch 522 the number of resistors 519–521 to be connected between the power source 515–518 and the motor 514. This system is disadvantageous in that with increase of load on the motor, an electric current increases and a voltage drop induced by the inserted resistors increases, thus causing a substantial drop of voltage applied to the motor when required, and the torque decreases. Consequently, despite of a residual capacity of the dry cells, a large load would cause the motor to stop rotation.

Figure 6:
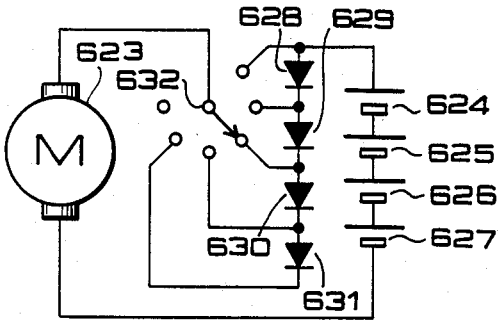
FIG. 6 is a circuit diagram showing an example of a speed adjusting system in a ball throwing machine according to the present invention.

Referring now to FIG. 6, there is shown a speed adjusting system in the ball throwing machine according to the present invention, in which speed adjustment for the ball throwing machine is effected by inserting diodes in series between a power source and a motor. Indicated at 623 is a motor, at 624 through 627 are dry cells, at 628 through 631 are diodes and at 632 is a change-over switch for changing the number of diodes to be inserted between the power source 624–627 and the motor 623. Diode, for example, silicon diode, usually exhibits a forward voltage drop of about 0.7 volts in linear scale, which can be regarded as being almost constant. Thus, in the circuit shown in FIG. 6 for adjusting the speed of the motor according to the present invention, even if the load on the motor 623 increases and the load current is thereby increased, the motor is driven at a constant voltage regardless of the load because the voltage drop induced by the diode is almost constant, and a sufficient rotating torque is obtained.

As set forth above, the present invention is advantageous in that a sufficient rotating torque is obtainable against load variations because the motor is driven at a constant voltage after subtraction of a forward voltage drop of diodes inserted in series between the power source and the motor in the ball throwing machine, and in that the speed adjustment can be effected in minute stages by a simple construction. Thus, it is possible to provide a portable ball throwing machine which makes the most of the feature of a dry cell-driven machine and which can be installed in any place whether the place is indoor or outdoor.

Figure 7:
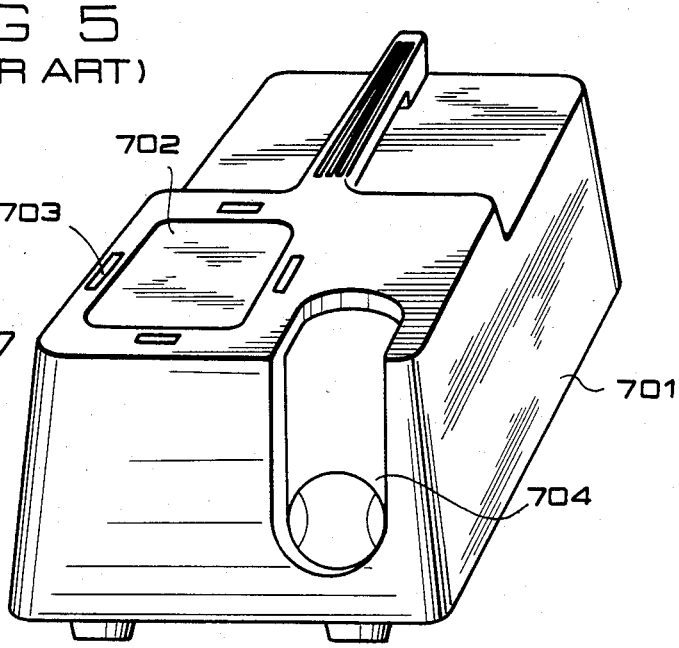
FIG. 7 is a perspective view of a housing member of the ball throwing machine of the invention.

Referring now to FIG. 7, there is shown a perspective view of a housing member including a ball intake portion for feeding collected balls to a machine portion which constitutes the ball throwing machine of the present invention. In the upper portion of a housing member 701 formed of plastic, sheet metal or like material is formed a ball intake port 702 for feeding balls collected by the net again to the machine portion, whereby the balls are conducted to the machine portion, and in the upper surface portion with a constant wall thickness of the housing member 704 are formed a plural member of through holes 703 in positions around the ball intake port 702. Further, in the front of the housing member 701 is formed an opening portion 704 for flying out therethrough of a ball hit by a hammer interlocked with a spring which has been accumulated its energy by a motor.

Figure 8:
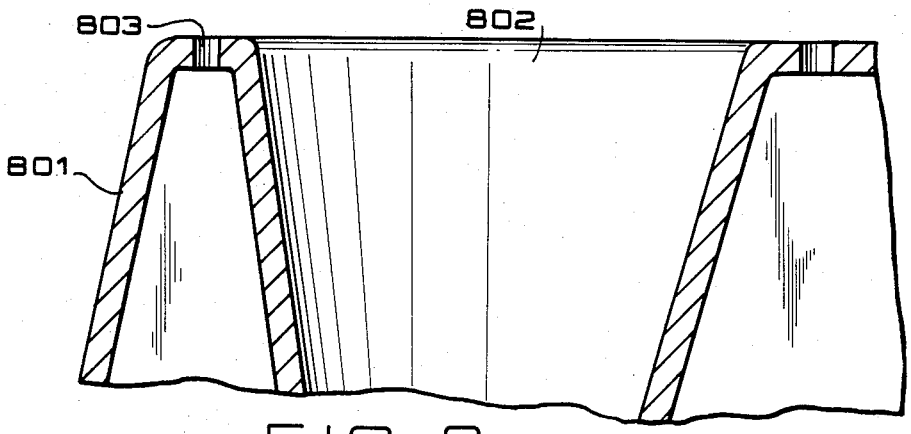
FIG. 8 is a fragmentary detailed sectional view around a ball intake port formed in the housing member of FIG. 7.

Referring now to FIG. 8, there is shown a fragmentary detailed sectional view of the portion around a ball intake port in the ball throwing machine of the present invention, in which a housing body 801 forms a ball intake port 802, and around the port 802 are formed a plural number of through holes 803.

Figure 9:
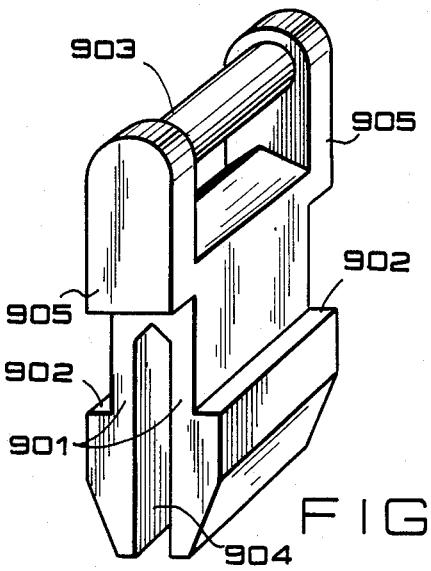
FIG. 9 is a perspective view showing an example of a retaining member according to the present invention.

Referring now to FIG. 9, there is shown a perspective view of a retaining member according to the present invention, in which elastic portions 901 and anticomingoff hook portions 902 are formed of a plastic or like material at the lower end portion, while at the upper end portion is provided a cylindrical portion 903. Between the two elastic portions 901 is formed a space 904, and when pressure is applied to the inside from the exterior of the elastic portion 901, the elastic portions are elastically deformed at positions above the hook portions 902 and contract, while upon relief of the pressure they revert to the original state. The hook portions 902 serve to prevent the retaining member from coming off upward, while a downward movement is restricted by projections 905.

Figure 10:
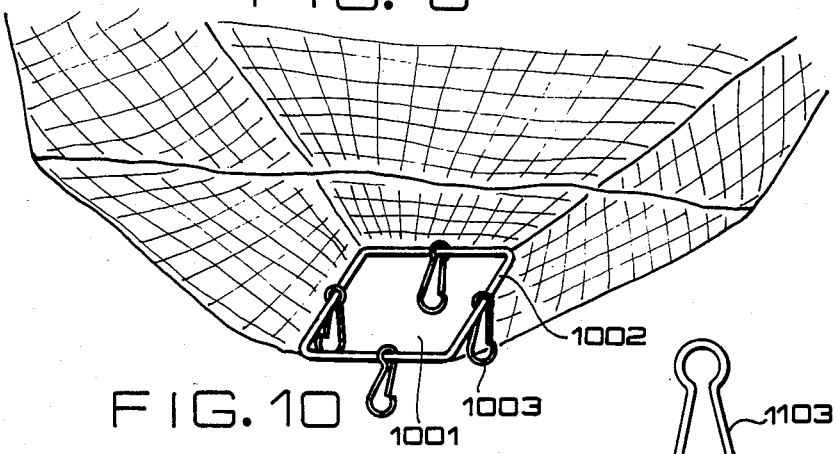
FIG. 10 is a perspective view of a ball collection net with hooks attached to the hem of a ball collection port of the net.

Referring now to FIG. 10, there is shown a fragmentary perspective view of a ball collection port formed in the bottom of a collection net for collection of balls into the ball throwing machine and of hooks attached to the hem of the ball collection port, in which a ball collection port 1001 is hemmed with, for example, a wire 1002 having a sufficient strength, to which are attached a plural number of hooks 1003. As the hooks 1003 there are used the so-called loop clutch or the like.

Figure 11:
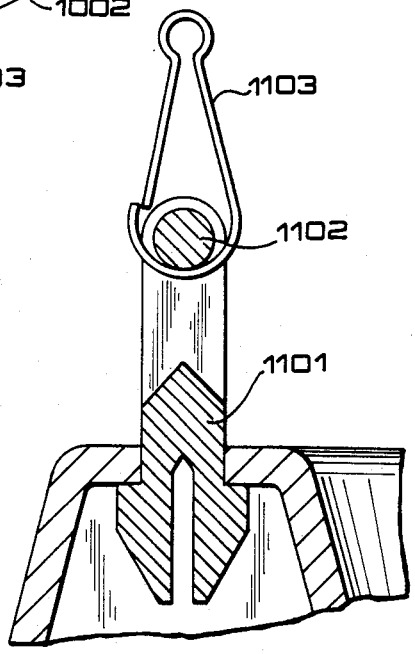
FIG. 11 is a sectional view showing a state of connection between retaining member and hook according to the present invention.

FIG. 11 is a sectional view showing a state of connection between a retaining member and hooks attached to a ball collection net according to the present invention, in which a hook 1103 attached to the hem of a ball collection port formed in the bottom of the net is engaged with a cylindrical portion 1102 provided at the upper portion of a retaining member 1101. As the hook 1103 there is used a loop clutch or the like, which can be detached easily.

Thus, the connector for connection between the ball throwing machine and the ball collection net in the present invention is extremely simple in structure, and the use of the retaining member permits simplification in structure of the housing member, thus leading to reduction of the cost. Futhermore, if there is used nylon 66, nylon 6 or the like as the material of the retaining member, it is possible to provide a ball throwing machine with a ball collection net of an extremely superior durability.

Figure 12:
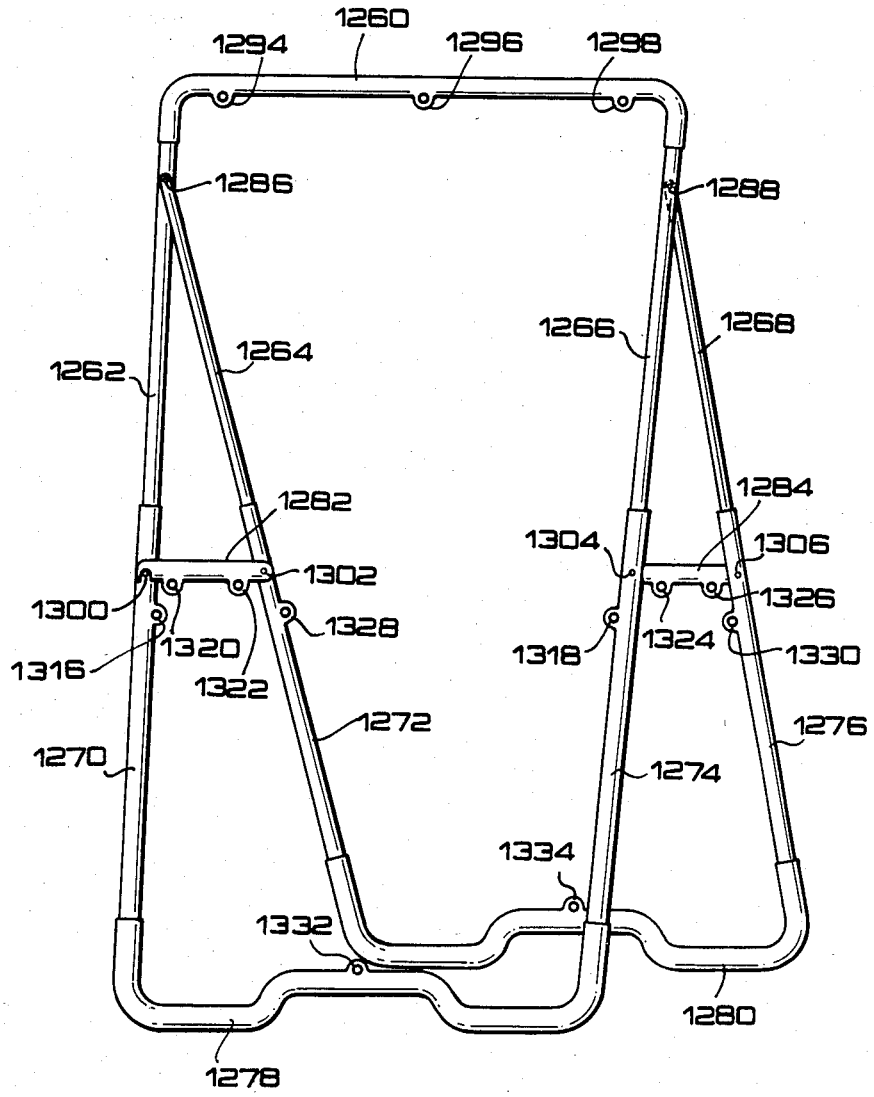
FIG. 12 is an exterior view showing the pipe-net according to the present invention in which FIG. 12 (A) is a perspective view showing only a pipe frame of the pipe-net of the invention, and FIG. 12 (B) is a perspective view showing the pipe-net in which a net part is mounted to the pipe frame of FIG. 12 (A).
Figure 12:
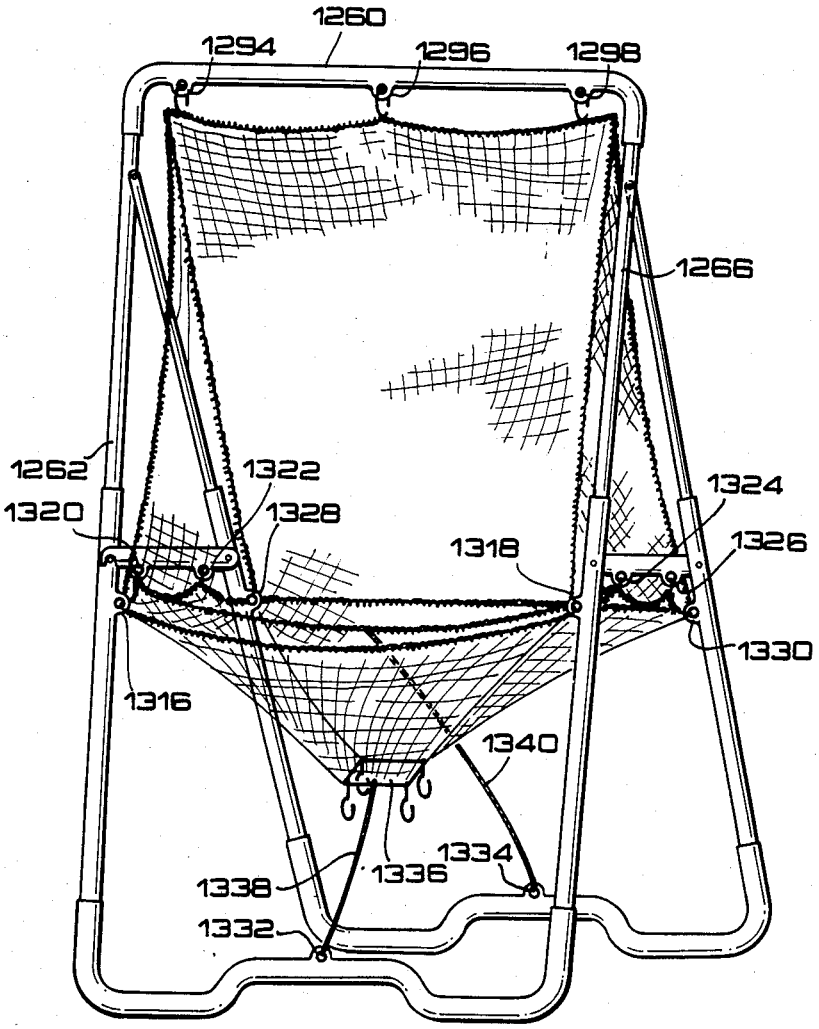

FIGS. 12 (A) and 12 (B) are perspective views showing an embodiment of the pipe-net for training tennis according to the present invention wherein FIG. 12 (A) shows only a pipe frame of the pipe-net according to the invention and FIG. 12 (B) shows the pipe-net in which a net part is mounted on the pipe frame.

In FIG. 12 (A), the pipe frame comprises thirteen pipes 1260, 1262, 1264, 1266, 1268, 1270, 1272, 1274, 1276, 1278, 1280, 1282 and 1284. This pipe frame is constructed by such a manner that a rectangular frame A consisting of the top pipe 1260, left-hand pipes 1262 and 1270, right-hand pipes 1266 and 1274, and the bottom pipe 1278 is pivotally linked with a U-shaped frame B consisting of left-hand pipes 1264 and 1272, right-hand pipes 1268 and 1276, and the bottom pipe 1280 at points 1286 and 1288, respectively, and a pipe 1282 is utilized as a bridge between the left-hand pipes 1270 and 1272 of both the frames A and B, whilst a pipe 1284 is employed as a bridge between the right-hand pipes 1274 and 1276 of both the frames.

Opposite ends of the top pipe 1260 are bent with a substantially right angle. In the embodiment of FIG. 12 (A), the resulting top pipe 1260 is fitted to the left-hand pipe 1262 and the right-hand pipe 1266 in such that each end of the left- and right-hand pipes 1262 and 1266 is covered with either bent end of the top pipe 1280 thereby to link the top pipe with the left-hand pipes as well as the right-hand pipes, and at the same time, fixation of the pipe frame is intended at the corner parts thereof.

In order to make the linkage of the pipes in accordance with the manner as mentioned above possible, the points 1286 and 1288 for linking the frame A with the frame B are located slightly under from both the extreme ends of the pipes 1262 and 1266, respectively.

FIG. 12 (B) shows the pipe frame of FIG. 12 (A) to which a net part is mounted wherein a total of thirteen suspension members 1294, 1296, 1298, 1316, 1318, 1320, 1322, 1324, 1326, 1328, 1330, 1332 and 1334 are welded to the respective pipes of the pipe frame. Of course, the suspension member is not limited to such shape as described above, but a ring-formed member may also be employed and it may be applied in such a way that these ring-form members are passed through the respective pipes to fix the net part to the pipe frame by means of physical force thereby to attain the same functions as those of the above suspension members.

In this embodiment, swivel joint rings for connecting the welded suspension members directly or through a rope with the net part are utilized so that if such swivel joint rings are simply suspended on the suspension members, the mounting of the net part to the pipe frame completes. A period of time for completing such mounting requires from 30 seconds to 1 minute so that it requires only 2–3 minutes for completely assembling the pipe net according to the present invention.

Furthermore, the net is connected to the corresponding suspension members by means of before and behind two ropes 1338 and 1340, respectively, with a certain tension in such that balls recovered are smoothly retained in the tennis training machine through a ball collection port 1336. In this arrangement, the top pipe 1260 is downwardly stretched so that a more favorable fitting of the top pipe 1260 with both the pipes 1262 and 1266 can be maintained, even if there is some swinging motion in the pipe-net.

In the embodiment shown in FIGS. 12 (A), and 12 (B), each opposite end of both the top and bottom pipes is worked to bend it with a substantially right angle so that insertion of the left- and right-hand pipes into the top pipe is intended in such that the opposite ends of the top pipe cover each top end of the left- and right-hand pipes, whilst fitting of the left- and right-hand pipes into the bottom pipe is contemplated by inserting each bottom end of the left- and right-hand pipes into the opposite ends of the bottom pipe.

This is because the top pipe requires a certain strength for putting up a net, whilst because there might be such a case that the bottom pipe is erroneously stamped down by user's feet so that it is intended to afford a certain strength to the pipe frame structure.

In the present invention, the pipe frame and the net part are considered to be an integral structure, in other words, it is intended to obtain a favorable connection of the pipe frame and to increase the solidity of such pipe frame structure, the pipes of which are manufactured to maintain easiness in their assembling as the initial requirement, by utilizing such a structure of the net part by which balls drop easily thereinto and the balls are easily recovered, whereby utility as well as easiness in use of the portable tennis training machine are remarkably elevated.

What is claimed is:

1. A ball throwing machine comprising:

(a) a drive motor connected to a power source;

(b) a reduction machanism for reducing the rotating speed of said drive motor;

(c) a one-way clutch mechanism connected to said reduction mechanism;

(d) a shaft for transmitting the rotating force of the motor through said clutch mechanism;

(e) a ball hitting lever fixed to said shaft;

(f) a spring mechanism for imparting a pivoting force to said hitting lever;

(g) a switch for making and breaking an electric current to said motor;

(h) a safe detecting member for detecting a foreign object; and (i) means for causing said safe detecting member to actuate said switch to break said power source upon detection of the foreign object, said safe detecting member being a lock cover which is movably positioned adjacent the rotation trace of said hitting lever.

2. A ball throwing machine according to claim 1, characterized by further including an armature attached to said switch and engageable by said lock cover, and further including a return spring for urging said lock cover toward the front of said ball throwing machine and away from said armature at all times whereby upon removal of said foreign object from between said hitting lever and said lock cover, said armature of said switch is released, said motor again starts operating and said lock cover reverts to its original position automatically.

* * * * *